US008394042B1

(12) United States Patent
Mirza

(10) Patent No.: US 8,394,042 B1
(45) Date of Patent: Mar. 12, 2013

(54) PORTABLE SEQUENTIAL COMPRESSION DEVICE

(76) Inventor: Mansoor Mirza, Manitowoc, WI (US)

( * ) Notice: Subject to any disclaimer, the term of this patent is extended or adjusted under 35 U.S.C. 154(b) by 669 days.

(21) Appl. No.: 12/561,942

(22) Filed: Sep. 17, 2009

(51) Int. Cl.
*A61H 9/00* (2006.01)

(52) U.S. Cl. ..... 601/150; 601/149; 601/152; 602/13

(58) Field of Classification Search ..... 601/148–152; 602/13; 128/DIG. 20
See application file for complete search history.

(56) References Cited

U.S. PATENT DOCUMENTS

| | | | | |
|---|---|---|---|---|
| 2,880,721 | A | 4/1959 | Corcoran | |
| 3,865,103 | A | 2/1975 | Folman | |
| 4,029,087 | A | 6/1977 | Dye et al. | |
| 4,091,804 | A | 5/1978 | Hasty | |
| 4,827,912 | A | 5/1989 | Carrington et al. | |
| 5,014,681 | A | 5/1991 | Heeman et al. | |
| 5,496,262 | A | 3/1996 | Johnson, Jr. et al. | |
| 5,588,955 | A | 12/1996 | Johnson, Jr. et al. | |
| 6,463,934 | B1 | 10/2002 | Johnson, Jr. et al. | |
| 7,063,676 | B2 | 6/2006 | Barak et al. | |
| 2002/0042583 | A1* | 4/2002 | Barak et al. | 601/1 |
| 2005/0222526 | A1* | 10/2005 | Perry et al. | 601/152 |
| 2008/0071202 | A1* | 3/2008 | Nardi et al. | 601/98 |
| 2010/0268130 | A1* | 10/2010 | Khan | 601/46 |

FOREIGN PATENT DOCUMENTS

| | | |
|---|---|---|
| WO | WO01/37776 | 5/2001 |
| WO | WO2004/084790 | 10/2004 |

OTHER PUBLICATIONS

Http://www.kendallvascularthera oy.com/VascularTherapy—Product: Sequential Compressio System, (2009).
http://www.aircast.com/index.asp/fuseaction/products.detail/cat/5/id/80products: ArterialFlow System and VenaFlow System, (2009).

* cited by examiner

*Primary Examiner* — Quang D Thanh
(74) *Attorney, Agent, or Firm* — Michael I. Kroll

(57) ABSTRACT

A portable sequential compression device mountable to an appendage designed to facilitate blood circulation through the appendage veins of users that remain sedentary whether bed ridden or sitting for extended periods of time whereby the normal blood flow induced by expansion and contraction of the muscles doesn't occur, which can lead to thrombi and edema within the appendage. The device comprises a portable pump and a series of bladders transversely encircling the target appendage whether arm or leg that through. the intermittent compression aids blood flow across the capillaries.

7 Claims, 11 Drawing Sheets

PORTABLE SEQUENTIAL COMPRESSION DEVICE

BACKGROUND OF THE INVENTION

1. Field of the Invention

The present invention relates generally to compression devices and, more specifically, to a portable sequential compression device mountable to an appendage designed to facilitate blood circulation through the appendage veins of users that remain sedentary whether bed ridden or sitting for extended periods of time whereby the normal blood flow induced by expansion and contraction of the muscles doesn't occur, which can lead to thrombi and edema within the appendage.

The device comprises a portable pump and a series of bladders transversely encircling the target appendage whether arm or leg that through. the intermittent compression aids blood flow across the capillaries.

The number of bladders arrayed transversely is a design consideration and can be greater than or less than that illustrated in the figures.

2. Description of the Prior Art

There are other compression devices designed for compression. While these compression devices may be suitable for the purposes for which they were designed, they would not be as suitable for the purposes of the present invention, as hereinafter described.

SUMMARY OF THE PRESENT INVENTION

A primary object of the present invention is to provide a portable sequential compression device for appendages.

Another object of the present invention is to provide a portable sequential compression device for appendages comprising a control unit and a compression sleeve.

Yet another object of the present invention is to provide a portable sequential compression device wherein said compression sleeve has a plurality of transverse bladders with mating longitudinal fasteners on each side.

Still yet another object of the present invention is to provide a portable sequential compression device wherein each of said bladders has a value for inflating and a valve for deflating the bladder.

Another object of the present invention is to provide a pump having housing with circuit for actuating said pump using AC or DC current.

Yet another object of the present invention is to provide a pump having switches for setting the amount of pressure for the bladders.

Still yet another object of the present invention is to provide a pump having switches for setting the duration of treatment.

An additional object of the present invention is to provide the pump housing with audio and/or visual indicator that treatment is complete.

Additional objects of the present invention will appear as the description proceeds.

The present invention overcomes the shortcomings of the prior art by providing a portable sequential compression device mountable to an appendage designed to facilitate blood circulation through the appendage veins of users that remain sedentary whether bed ridden or sitting for extended periods of time whereby the normal blood flow induced by expansion and contraction of the muscles doesn't occur, which can lead to thrombi and edema within the appendage. The device comprises a portable pump and a series of bladders transversely encircling the target appendage whether arm or leg that through. the intermittent compression aids blood flow across the capillaries. The number of bladders arrayed transversely is a design consideration and can be greater than or less than that illustrated in the figures.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
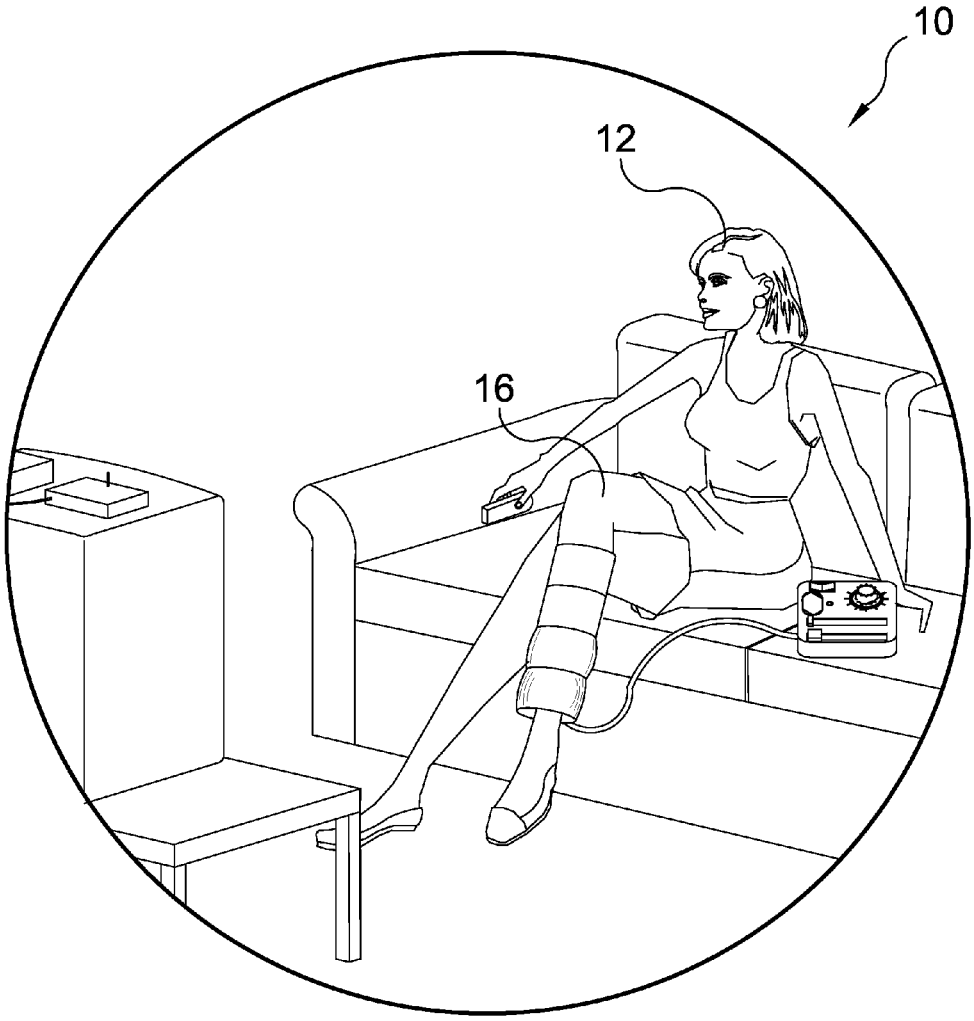
FIG. 1 is an illustrative view of the portable sequential compression device in use.

Turning now descriptively to the drawings, in which similar reference characters denote similar elements throughout the several views, the figures illustrate the Portable Sequential Compression Device of the present invention. With regard to the reference numerals used, the following numbering is used throughout the various drawing figures.

| | |
|---|---|
| 10 | Portable Sequential Compression Device of the present invention |
| 12 | user |
| 14 | transverse bladder |
| 16 | appendage |
| 18 | compression sleeve |
| 20 | control unit |
| 22 | mating fasteners |
| 24 | housing |
| 26 | air compression pump |
| 28 | external switches |
| 30 | conduit |
| 32 | fill valve |
| 34 | bleeder valve |
| 36 | power source |

-continued

| | |
|---|---|
| 38 | circuit |
| 40 | control unit fastener |
| 42 | audio indicator |
| 44 | visual indicator |
| 46 | AC power cord |
| 48 | rechargeable battery |
| 50 | longitudinal bladder |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the portable sequential compression device 10 in use. The portable sequential compression device, illustrated encompassing a user's 12 leg, is a device mountable to an appendage 16 for moving blood through the appendage veins of users that remain sedentary whether bed ridden or sitting for extended periods of time whereby the normal blood flow induced by expansion and contraction of the muscles doesn't occur, which can lead to thrombi and edema within the appendage.

Figure 2:
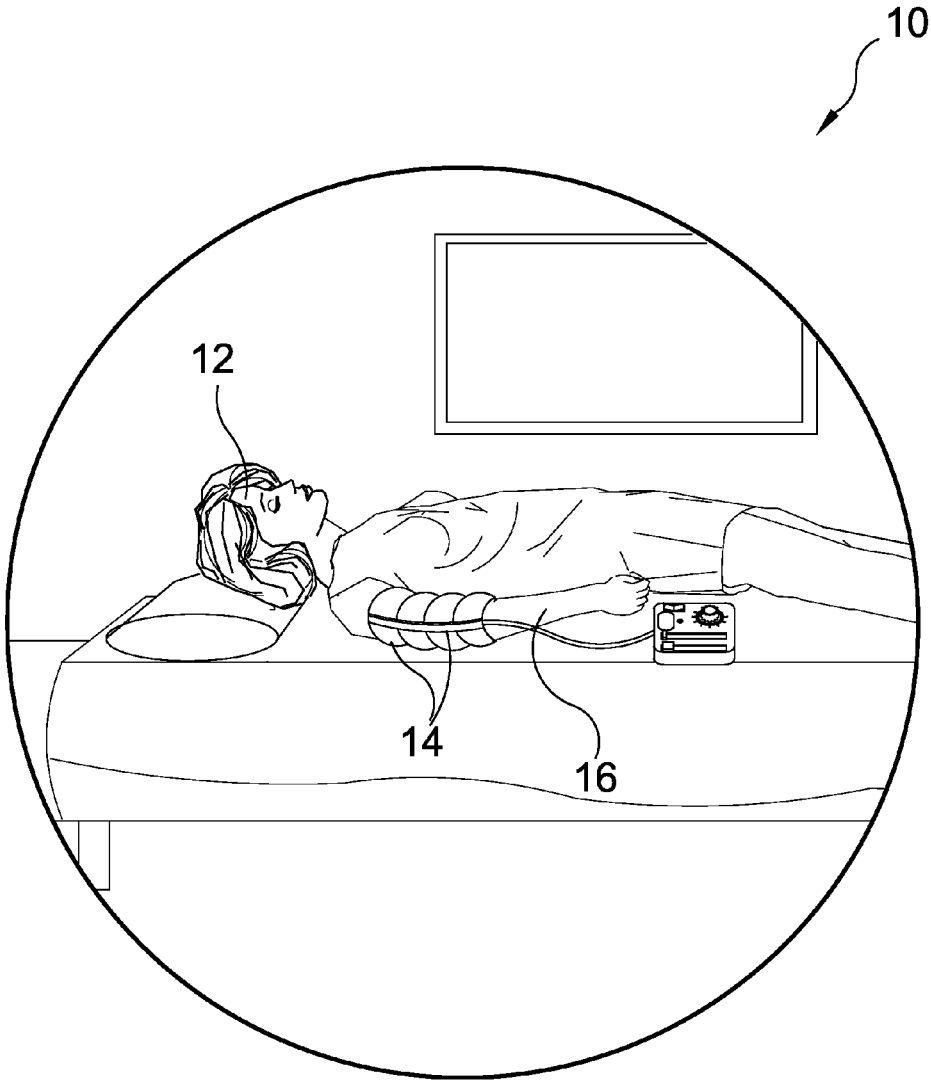
FIG. 2 is another illustrative view of the portable sequential compression device in use.

FIG. 2 is another illustrative view of the portable sequential compression device 10 in use. Illustrated is the portable sequential compression device 10 designed to facilitate blood circulation back to the heart through sequential inflation and deflation of a series of bladders 14 transversely encircling the target appendage 16. Illustrated is the device attached to a user's 12 arm to prevent venous blood stasis and through the intermittent compression aid blood flow across the capillaries. The number of bladders 14 arrayed transversely is a design consideration and can be greater than or less than that illustrated in the figures.

Figure 3:
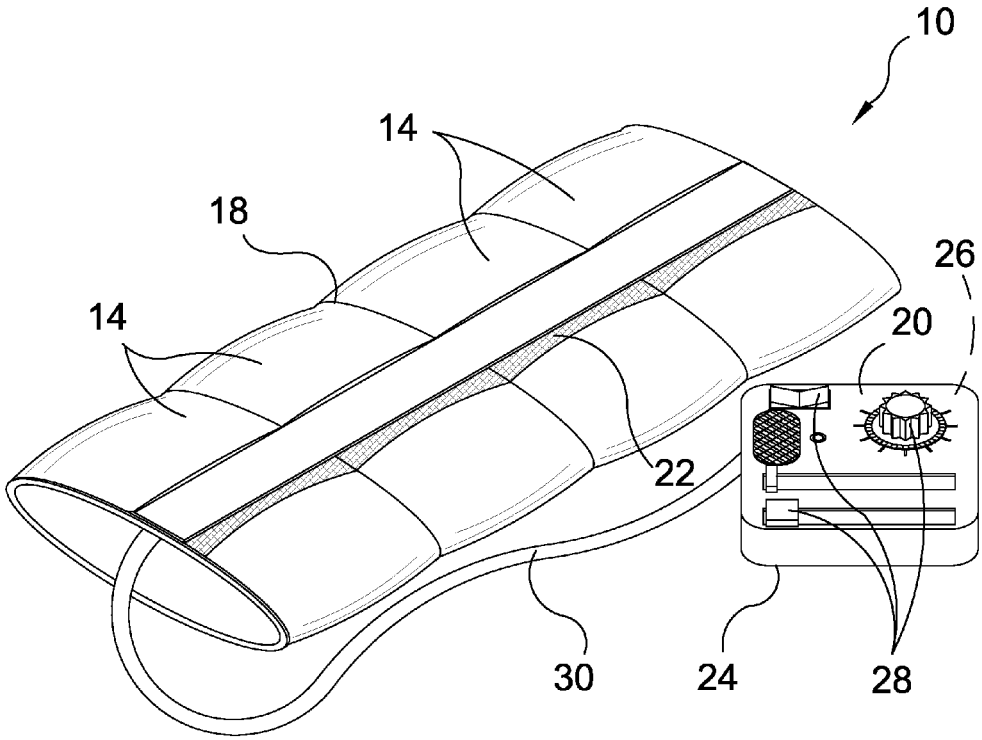
FIG. 3 is an illustrative view of the portable sequential compression device closed.

FIG. 3 is an illustrative view of the portable sequential compression device 10. The portable sequential compression device provides a sequential compression sleeve 18, a control unit 20 and a conduit 30 communicating therebetween. The compression sleeve 18 comprises a plurality of transverse bladders 14 and longitudinal mating fastener 22 for securing the compression sleeve 18 to an appendage. The control unit 20 has a housing 24 for an air compression pump 26 with external switches 28 for actuating the pump.

Figure 4:
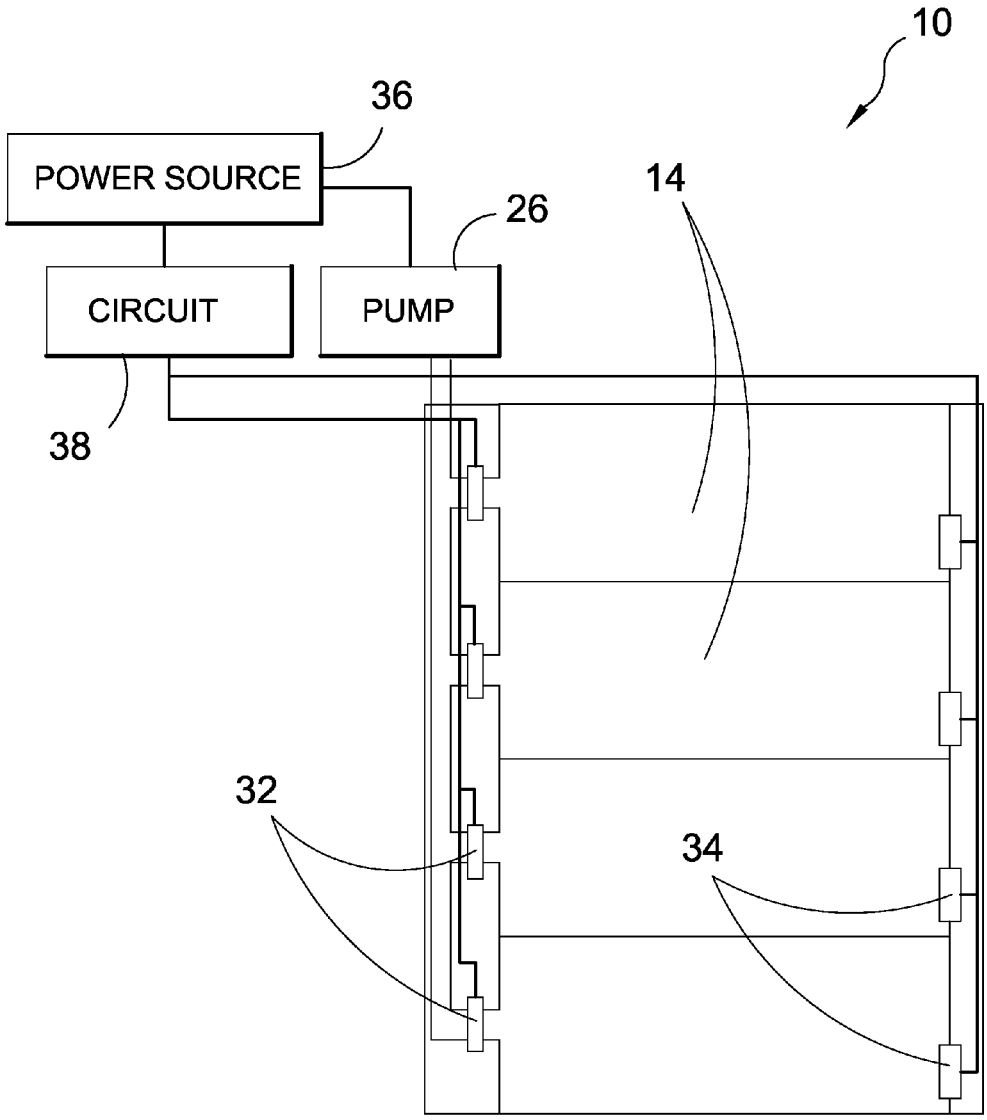
FIG. 4 is a diagrammatic view of the present invention.

FIG. 4 is a diagrammatic view of the present invention 10. Shown is the portable sequential compression device 10 having a plurality of bladders 14 with fill valves 32 and bleed valves 34 for applying a preselected amount of pressure to an appendage within the compression sleeve 18. A power source 36 supplies power to the circuit 38 and the pump 26 that fills the bladders 14.

Figure 5:
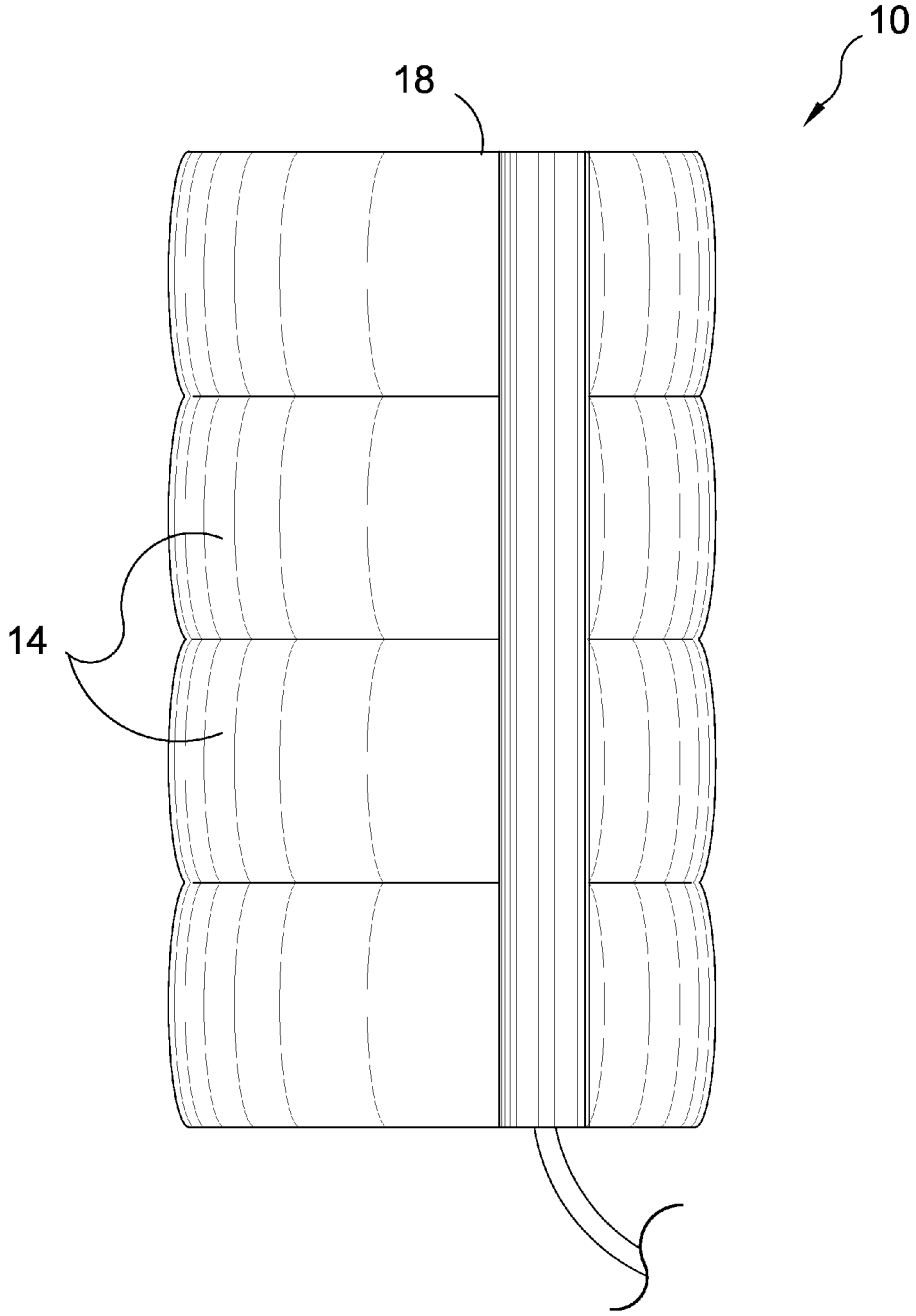
FIG. 5 is a closed view of the compression sleeve.

FIG. 5 is a closed view of the compression sleeve 18 of the present invention 10. It is envisioned that a varying number of bladders 14 can be contained within the compression sleeve 18, such as small medium or large.

Figure 6:
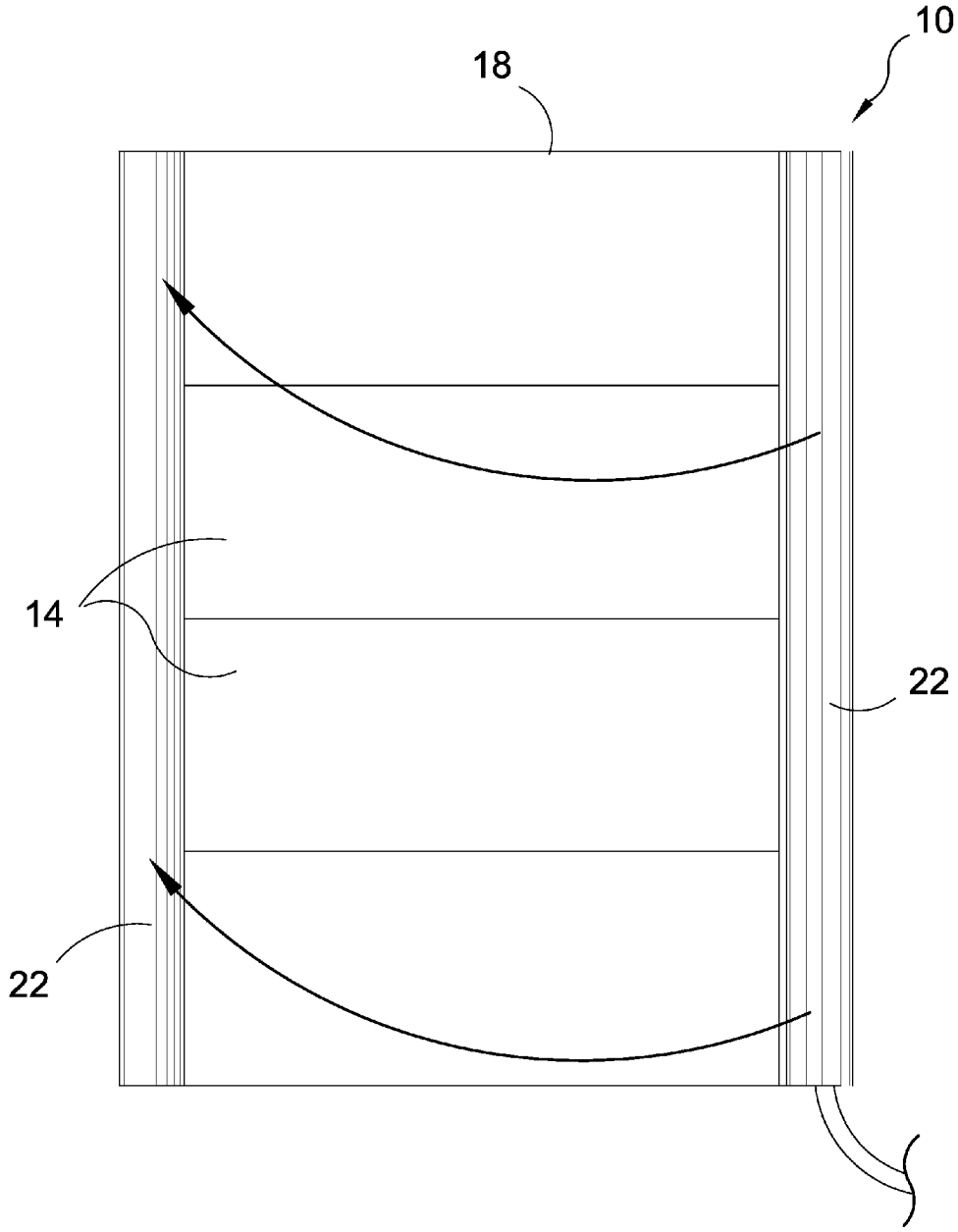
FIG. 6 is an open view of the compression sleeve.

FIG. 6 is an open view of the compression sleeve 18 of the present invention 10. As aforementioned, it is envisioned that a varying number of bladders 14 can be contained within the compression sleeve 18, such as small medium or large having mating longitudinal fasteners 22 along the opposing edges.

Figure 7:
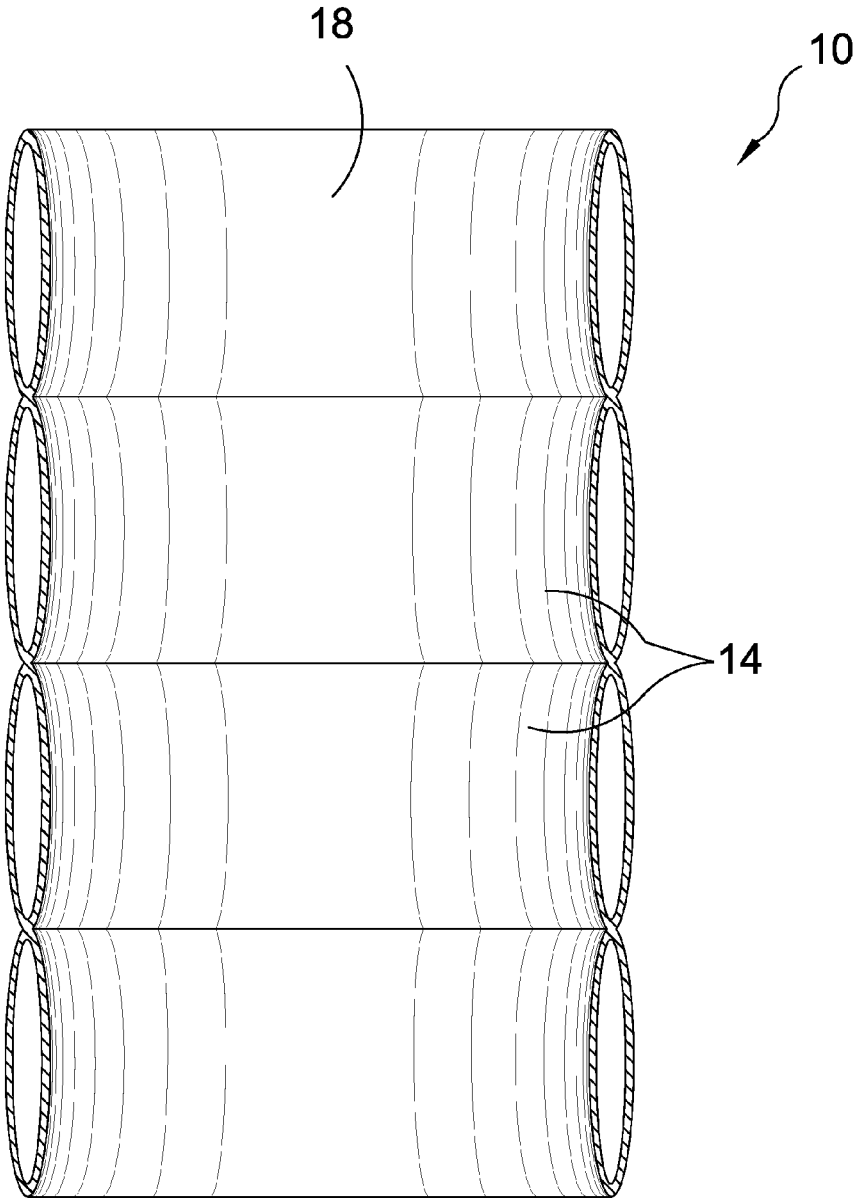
FIG. 7 is a sectional view of the bladders.

FIG. 7 is a sectional view of the bladders 14 of the present invention 10. Shown is a sectional view of the individual bladders 14 in the compression sleeve 18. Each bladder 14 has a fill valve and bleed valve that are used to control the amount of pressure within the bladder 14 and the bleed time of the bladder 14.

Figure 8:
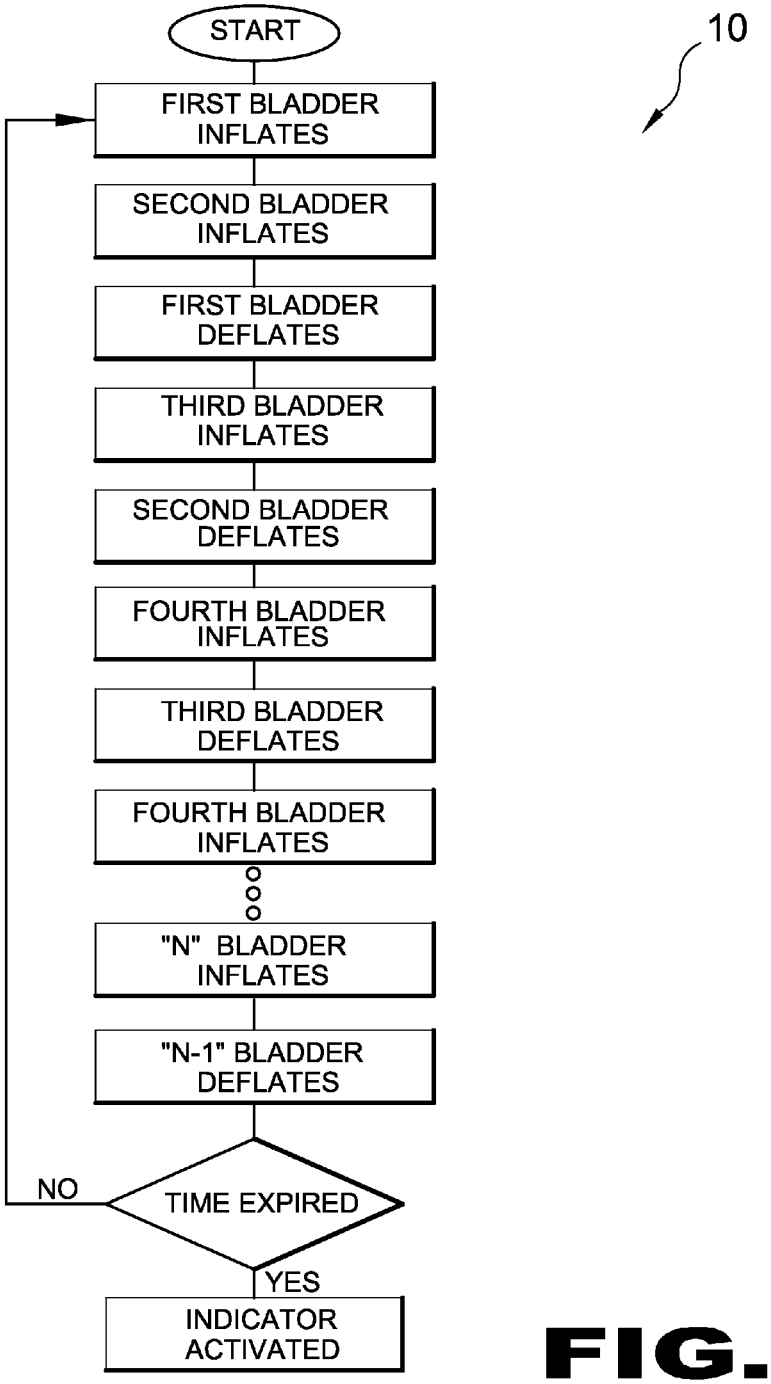
FIG. 8 is a chart of the portal sequential compression device.

FIG. 8 is a chart of the portable sequential compression device 10.

The present invention 10 provides for a portable pump having controls for filling and bleeding a plurality of bladders in a predetermined sequence to force blood circulation from the vein to the heart. The control can additionally provide for psi selection, bladder cycle time and sleeve cycle time.

Figure 9:
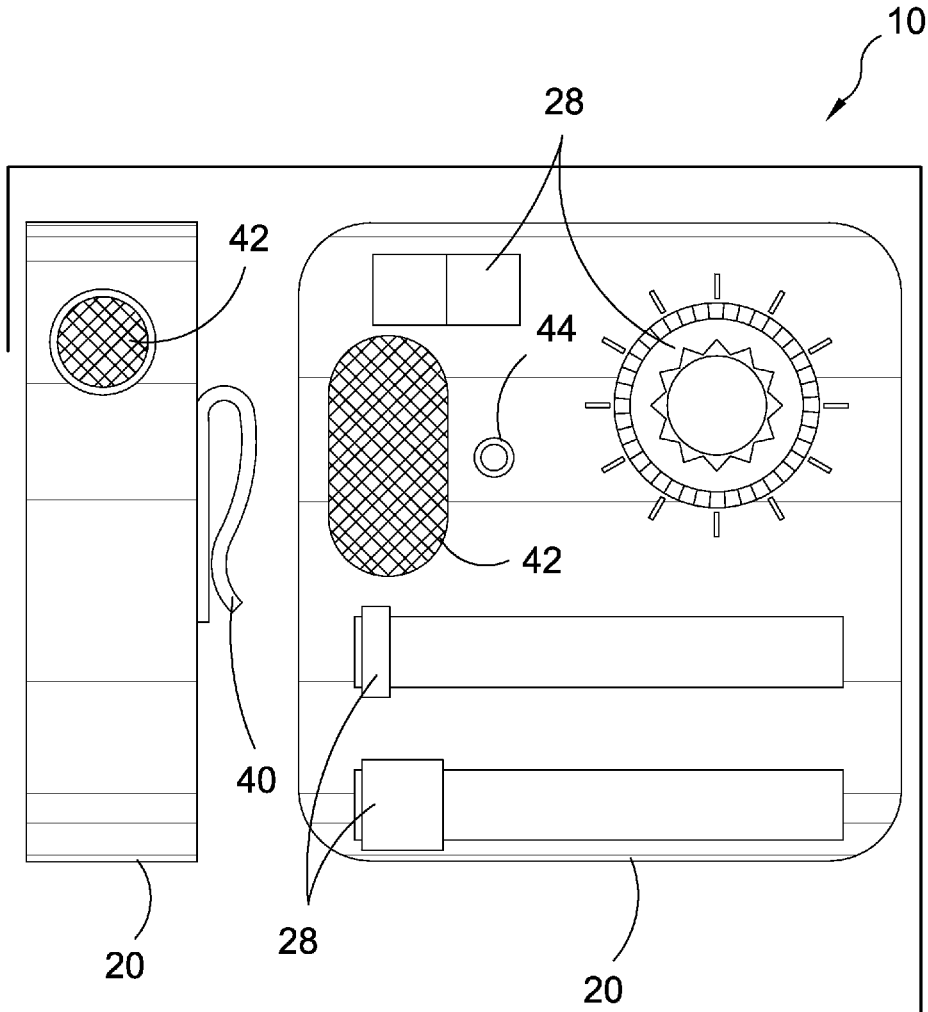
FIG. 9 is a front and side view of the pump controller.

FIG. 9 is a front and side view of the pump controller unit 20 of the present invention 10. The portable pump provides fastener 40 for attaching to an article of apparel and control switches 28 for selecting the amount of bladder pressure, bladder cycle time and treatment time that when expired may include an audio 42 or visual indicator 44 that treatment is completed.

Figure 10:
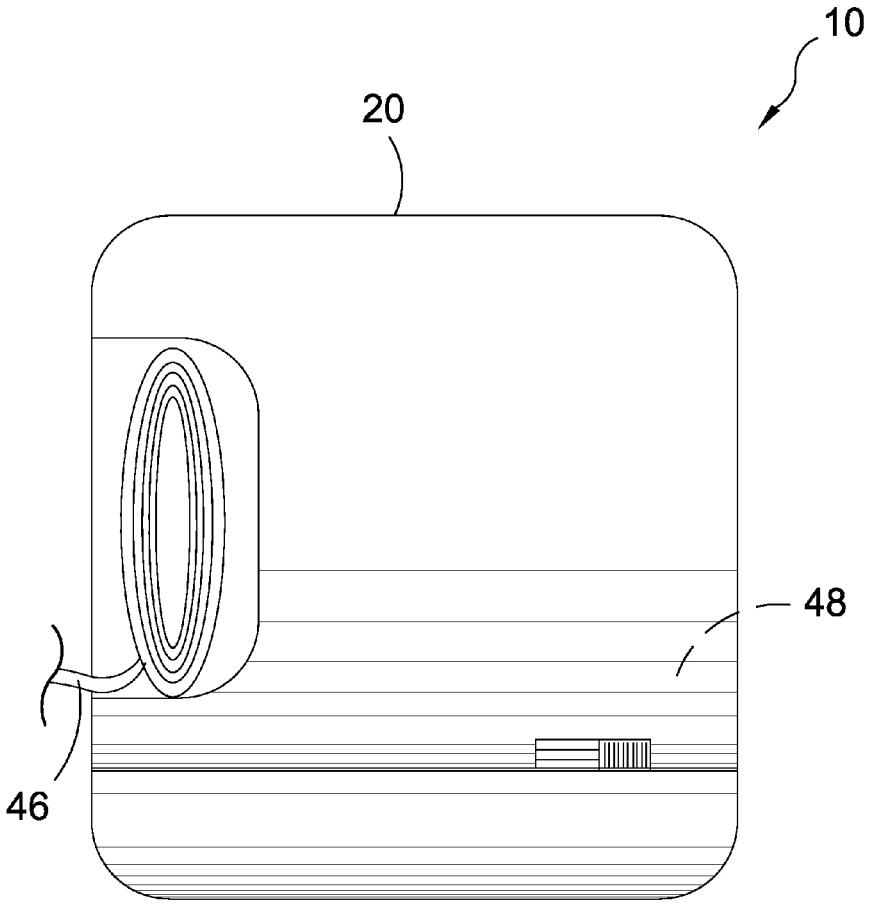
FIG. 10 is a back view of the pump controller.

FIG. 10 is a back view of the pump controller unit 20 of the present invention 10. The portable pump also provides for rechargeable batteries 48 and a wall socket cord 46 to either recharge the batteries or run the device using ac current.

Figure 11:
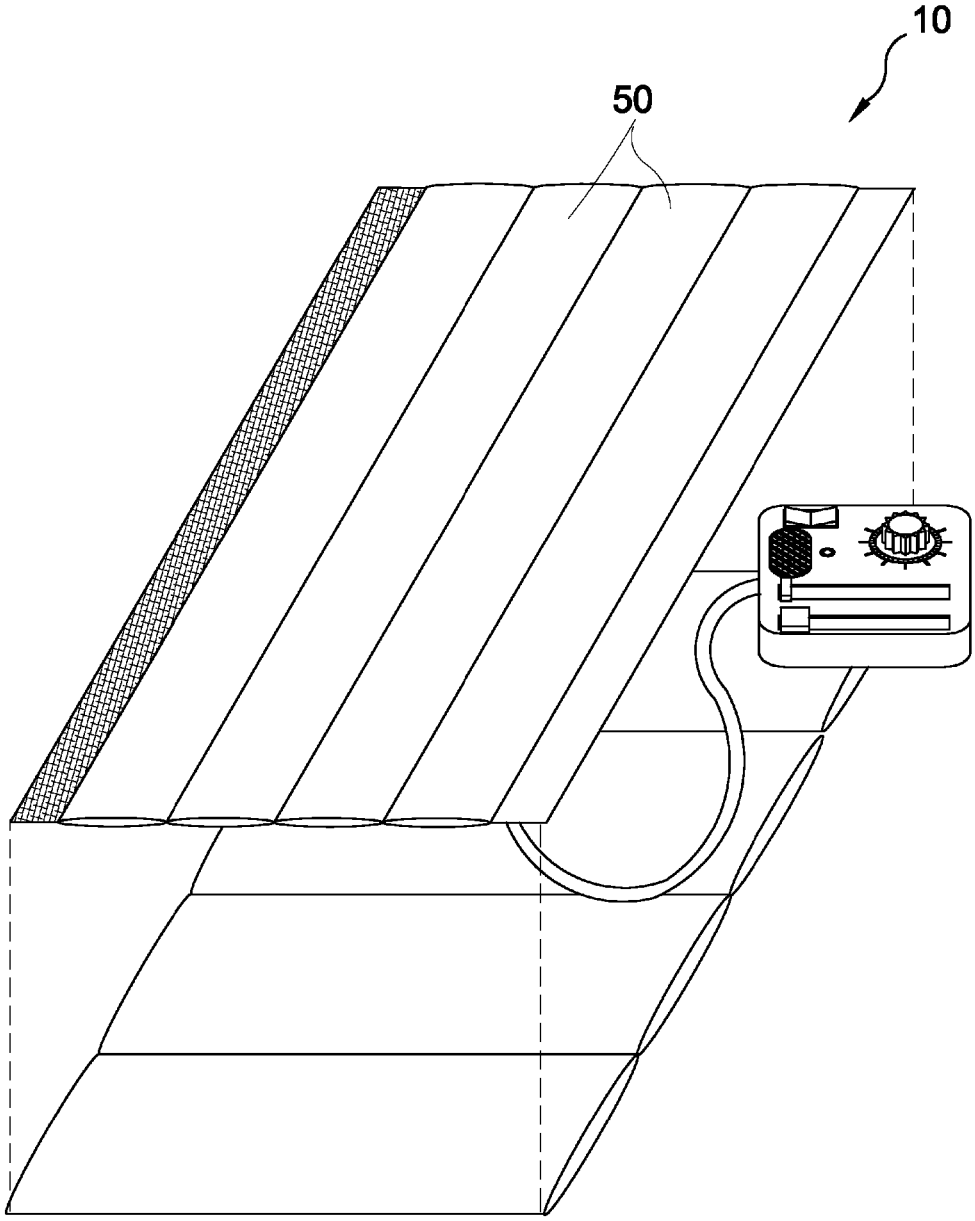
FIG. 11 is the portable sequential compression device having an additional element.

FIG. 11 is the portable sequential compression device 10 having an additional element. The present invention 10 further provides for an embodiment of the present invention having the previously disclosed appendage transverse compression and as illustrated a plurality of longitudinal bladders 50 that can be used in concert with the transverse pressure or in lieu of transverse compression.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A portable sequential compression device comprising:

a) a compression sleeve having within a plurality of inflatable bladders transversely encircling an appendage of a user and having a longitudinal extending fastener for securing said sleeve around said appendage;

b) each bladder having separate fill and bleed valves mounted directly on said bladders and located opposite each other on said bladders;

c) a control unit having an air compression pump for inflating said bladders sequentially through said fill valves and deflating said bladders through said bleed valves so that a bladder is deflated after a following bladder is inflated;

d) a conduit communicating between said fill valves and said control unit; and e) said control unit comprising a housing, on a rear wall of said housing a clip for attaching said housing to an article of clothing, on a front wall of said housing a speaker for audible indication when a treatment time expires, a visual indicator, as well as control switches for selecting bladder pressure, bladder cycle time, and treatment time, and on a side wall of said housing another speaker.

2. The portable sequential compression device according to claim 1, wherein adjacent bladders abut each other.

3. The portable sequential compression device according to claim 2, wherein in each said bladder the bleeder valve does not discharge into another bladder.

4. The portable sequential compression device according to claim 1, wherein said longitudinal extending fastener includes mating fasteners disposed on opposing edges thereof for securing to the appendage of the user.

5. The portable sequential compression device according to claim 1, wherein said control unit has a power source.

6. The portable sequential compression device according to claim 5, wherein said power source is an AC power cord.

7. The portable sequential compression device according to claim 5, wherein said power source is at least one rechargeable battery.

* * * * *